United States Patent [19]

Meister

[11] 4,376,895

[45] Mar. 15, 1983

[54] ELECTROMECHANICAL SWITCHING DEVICE

[76] Inventor: Jack B. Meister, 68 Chimney Ridge Rd., Convent Station, N.J. 07961

[21] Appl. No.: 88,076

[22] Filed: Oct. 24, 1979

[51] Int. Cl.[3] ..... H01H 67/02

[52] U.S. Cl. ..... 307/9; 307/10 R; 307/142; 335/186

[58] Field of Search ..... 307/10 R, 141, 142, 307/134; 335/186, 188

[56] References Cited

U.S. PATENT DOCUMENTS 4,246,559 1/1981 Budrose ..... 335/186 X 4,276,483 6/1981 Hayden ..... 307/10 R

*Primary Examiner*—G. Z. Rubinson

*Assistant Examiner*—James L. Dwyer

*Attorney, Agent, or Firm*—H. Hume Mathews

[57] ABSTRACT

An electromechanical switching device has a housing containing an armature. This armature is mounted in the housing to reciprocate between a closed and an open position. A coil mounted near the armature in the housing can magnetically hold the armature in its closed position. A manually operable member is mounted in the housing to reciprocate between a set and a reset position. This member can be moved into the set and reset positions to drive the armature toward its closed and open positions, respectively. Being arranged in this fashion the coil can be operated by a relatively small current. This current may be insufficient to attract the armature from its open to its closed position. However, the full travel of the armature is accomplished by the combined effects of the manually operable member and the coil.

2 Claims, 7 Drawing Figures

ELECTROMECHANICAL SWITCHING DEVICE

BACKGROUND OF THE INVENTION

The present invention relates to electromechanical devices and in particular to a relay-like device which is operated by magnetic and manual forces.

To improve efficiency and reliability, it is desirable to operate an electromagnetic switching device with an electromagnetic coil that is driven by a relatively small current. An application thereof might be operation of an automobile accessory such as a defogger, either directly or through a timer. A straight-forward approach known to the prior art is to operate the accessory through a conventional relay that is actuated by a switch (the relay can be self-held through a timer). However, such apparatus requires a substantial current to flow through the switch and relay coil so that the relay armature can be drawn the usual distance. Such relatively high currents require relatively large and inefficient components. For environments such as an automobile where significant vibration is present, it is necessary to have the path travelled by the relay armature sufficiently long to prevent vibrations from causing inadvertent closure of the relay contacts. This practical requirement further increases the power required to drive a relay coil.

In applications where it is necessary to drive a remote accessory for a predetermined time interval, a momentary contact switch can be used to initiate operation of a timer which holds a relay in its closed position for this interval. This known system requires separate installations for the switch and the relay and wiring running therebetween. Having more than one assembly location increases the overall cost of the apparatus as well as the labor cost associated with the installation.

Examples of the prior art are given in U.S. Pat. Nos. 4,095,213 and 3,662,288.

SUMMARY OF THE INVENTION

In accordance with the illustrative embodiments demonstrating features and advantages of the present invention there is provided an electromechanical switching device having a housing, an armature, a coil means, and a manually operable member. The armature is mounted in the housing to reciprocate between a closed and an open position. The manually operable member is also mounted in the housing to reciprocate between a set and a reset position. This member is movable into the set and reset positions to urge the armature toward its closed and open positions, respectively. The coil means is also mounted in the housing for magnetically holding the armature in its closed position. This coil means is operated by a current insufficient to attract the armature from its open to its closed position. According to one embodiment of the invention, a timing means is included which is responsive to movement of the armature toward its closed position. This timing means can energize the coil means for a predetermined interval. According to another embodiment of the invention a switching means is included which energizes the coil means upon the armature arriving within a predetermined distance of its closed position.

By employing these elements the present invention avoids many problems and provides unique advantages. Since these elements may all be mounted in a single housing, only one assembly need be installed. Also the manually operable member assists the coil means so it is not required to provide the entire motive force which draws the armature to the closed position. Such an apparatus is particularly advantageous when used in connection with a timing device. For example, the armature can readily operate a timing means to drive an accessory for a predetermined interval.

The armature can be initially moved manually but then held in an operative position by the electromagnetic force produced by the coil means. Of course the electrical energy required simply to hold, as opposed to move, the armature is relatively small. Thus the coil means can be of a relatively low power rating which increases efficiency and reliability. The manually operable member can be operated as if it were the handle of a conventional momentary contact switch since it only need swing the armature toward its closed position and then allow the coil means to hold the armature. The coil means, the armature, the manually operable member and the timing means can be mounted within a compact housing which is nearly the size of a conventional momentary contact switch. Accordingly this entire assembly can be conveniently mounted in a conventional manner on the operator's panel or on the dashboard of a motor vehicle.

According to one embodiment of the present invention, the ignition system of a motor vehicle is electrically coupled to the disclosed apparatus so that the accessory operated thereby is not energized unless the ignition of the motor vehicle is on. This feature prevents excessive drain on the battery of a motor vehicle when it is not running. In connection with this embodiment, the manually operable member can close an auxilliary circuit and can bring the armature nearly but not actually into its closed position. The coil means is then energized and draws the armature into its closed position. This feature is exploited to prevent the operator from holding the armature in its closed position and operating the accessory when the engine is not running. This feature can also be exploited to isolate the power system of the accessory from that of the ignition system.

Accordingly, apparatus constructed according to the principles of the present invention can be fabricated inexpensively and can be made to operate reliably. The travel path of the armature can be made sufficiently long to prevent inadvertent contact closure caused by vibration. All of the significant components associated with a switching device according to the present invention can be mounted in a compact housing which may be mounted in an operator's panel or dashboard.

BRIEF DESCRIPTION OF THE DRAWINGS

The above brief description as well as other objects, features and advantages of the present invention will be more fully appreciated by reference to the following detailed description of the presently preferred but nonetheless illustrative embodiments in accordance with the present invention when taken in conjunction with the accompanying drawings wherein.

DETAILED DESCRIPTION OF THE PREFERRED EMBODIMENTS

Figure 1:
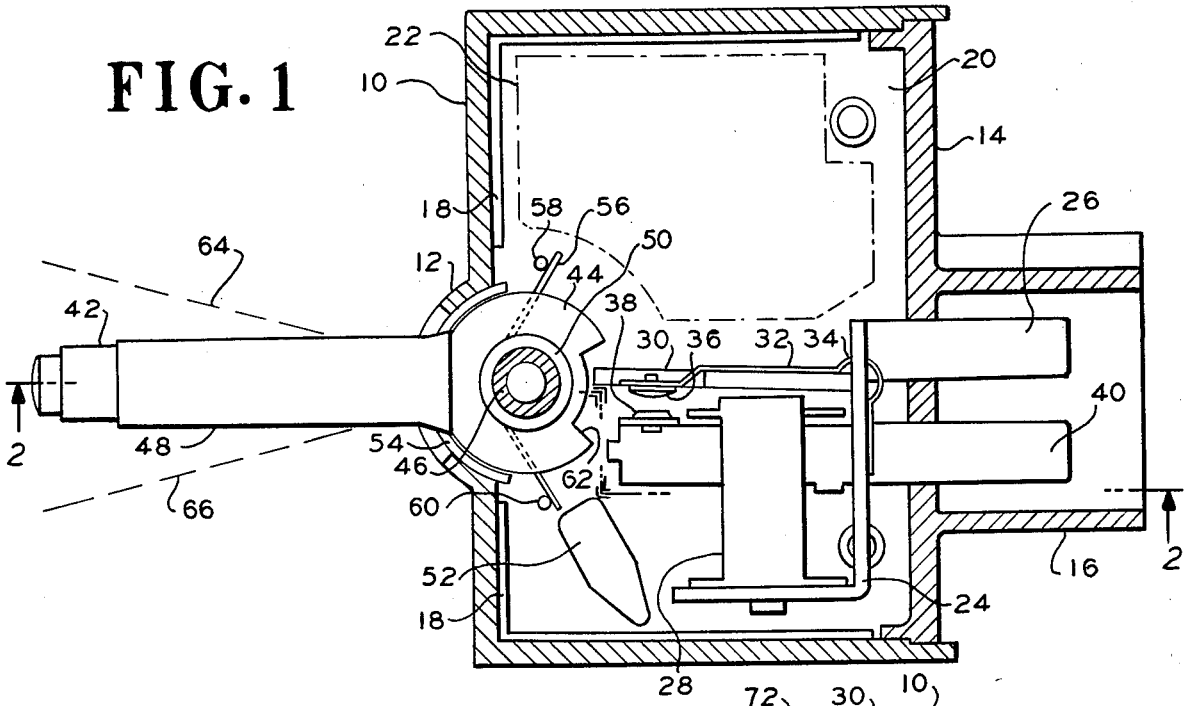
FIG. 1 is an elevational view, partly in section, of an electromechanical switching device in accordance with the present invention.

Referring to FIG. 1 there is shown a housing comprising an open, box-like member 10 having an apertured semi-cylindrical section 12. The rear of box 10 is closed by rear panel 14 which has rearwardly projecting from it four-sided, keyed shield 16.

Mounted in guides 18 is printed circuit board 20 which contains a circuit means comprising electronic components (described hereinafter) within area 22. Staked onto printed circuit board 20 is a frame 24 which has a general "L" shape and a tab 26 which is bent perpendicularly to emerge rearwardly into shield 16. As will become clear hereinafter tab 26 operates as a utilization means by providing switched power to an accessory.

A coil means (also referred to as part of a magnetic means) is shown herein as a bobbin 28 having a coaxial iron core (illustrated hereinafter). For clarity, the windings around bobbin 28 have not been illustrated, however these windings are wound in a well-known, conventional manner.

Also, an armature is shown herein as metal piece 30 which is hinged to frame 24 by means of a rearward tab that fits into frame 24. Piece 30 is staked to a cantilever 32 which is a thin leaf spring of berylium copper welded to the back side of frame 24. Leaf spring 32 passes through frame 24 at an aperture at location 34. Thus arranged, piece 30 and leaf spring 32 comprise an armature which is mechanically biased to remain in the position shown, in proximity to the upper end of coil 28. A movable electrical contact 36 is mounted on the free end of cantilevered leaf spring 32. In one embodiment silver cadmium oxide contacts were employed, however, other contact material can be employed instead. An opposite contact 38, mating with movable contact 36, is mounted on carrier frame 40 which is essentially an "L" shaped metal stamping having one arm bent into a plane orthogonal to that of the other arm. Frame 40 is staked to printed circuit board 20. Contacts 36 and 38 are aligned with one another and are normally spaced a distance corresponding to that of a conventional relay.

A manually operable member is shown herein as a lever 42 which is pivotally mounted at its central hub 44 by means of hollow rivet 46. Lever 42 is fabricated from a translucent material such as lexan and is covered by heat-shrink tubing 48. Rotation of lever 42 is facilitated by a washer 50. Lever 42 is made to emit light from its free end by means of a light source. This source is shown herein as light bulb 52 which is mounted on printed circuit board 20 at a position adjacent to hub 44. Leakage of light through the aperture in semicylindrical section 12 is prevented by a matching, semicylindrical, apertured light shield 54. Accordingly, an operator observes light emanating only from the free end or tip of lever 42 since light is blocked by shield 54 and tubing 48. Lever 42 is biased into the neutral position as shown by means of torsion spring 56. Torsion spring 56 is wound around rivet 46 below hub 44 and has two free ends that are restrained by upstanding stops 58 and 60. The side of hub 44 that faces printed circuit board 20 has a wedge shaped undercut whose oblique walls abut the free ends of torsion spring 56. Thus rotation of lever 42 causes torsion spring 56 to move away from either stop 58 or 60 and to wind into greater tension. Accordingly, torsion spring 56 biases lever 42 into the neutral position shown unless that lever is deflected manually.

The rear perimeter of hub 44 contains a notch 62 for engaging and deflecting the free end of cantilevered piece 30. Clockwise rotation (this view) of lever 42 causes the upper face of notch 62 to drive piece 30 downward a distance sufficient to close contacts 36 and 38. Correspondingly, the lower face of notch 62 is able upon counter-clockwise rotation of lever 42 to separate contacts 36 and 38. The total deflection angle possible for lever 42 is indicated by dotted lines 64 and 66.

Figure 2:
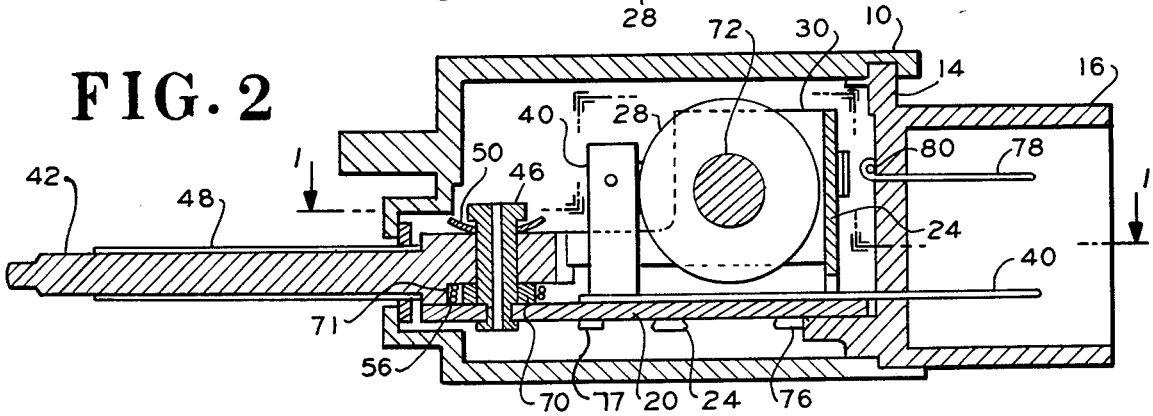
FIG. 2 is a bottom sectional view taken along line 2—2 of FIG. 1.

Referring now to FIG. 2, a bottom view of the foregoing apparatus along lines 2—2 of FIG. 1 is given. Corresponding elements in this and other figures are given the same reference numerals. As can be seen more clearly in this figure, coiled torsion spring 56 and its coaxial spacer 70 are fitted around rivet 46 and into the aforementioned wedge-shaped undercutting 71 in lever 42. Also an outline of the armature piece 30 is illustrated, dotted lines being used to show those portions which would ordinarily by hidden in this view. Also, bobbin 28 is shown together with its aforementioned core 72. Also clearly shown in this view is that washer 50 has the shape of a portion of a sphere. Also illustrated are staking tabs 74 and 76 which depend from frame 24 and stake it to board 20. A similar tab 77, staking frame 40 to board 20, is also shown.

It can also be seen by comparing FIGS. 1 and 2 that the partially sectioned view of FIG. 1 is a view along the lines 1—1 of FIG. 2. Accordingly, certain contact prongs such as prong 78 (FIG. 2) do not appear in FIG. 1. Contact prong 78 is molded into back 14 and bent around a wire 80, which wire is routed to portions of the circuit on board 20.

Figure 3:
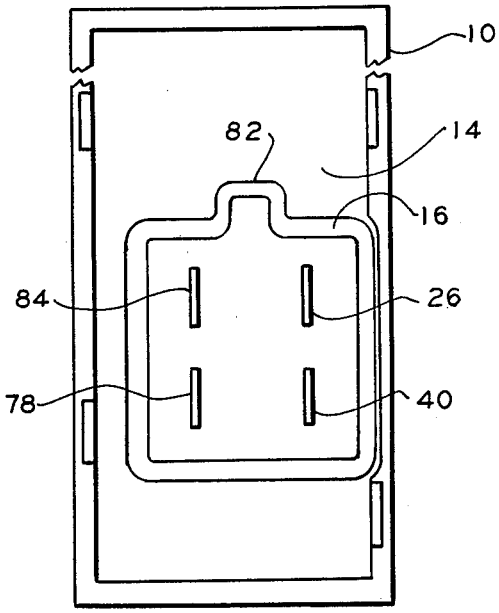
FIG. 3 is a rear elevational view of the device of FIG. 1.

Referring now to FIG. 3, a rear view of the apparatus of FIGS. 1 and 2 is shown. This view more clearly illustrates the outline of shield 16, which has a keyed upper portion 82. Also clearly illustrated in this figure are the four prongs emerging from back 14 into shield 16, namely previously illustrated prongs 26, 40 and 78 as well as prong 84. Prong 84 is shaped and mounted the same as prong 78.

Figure 4:
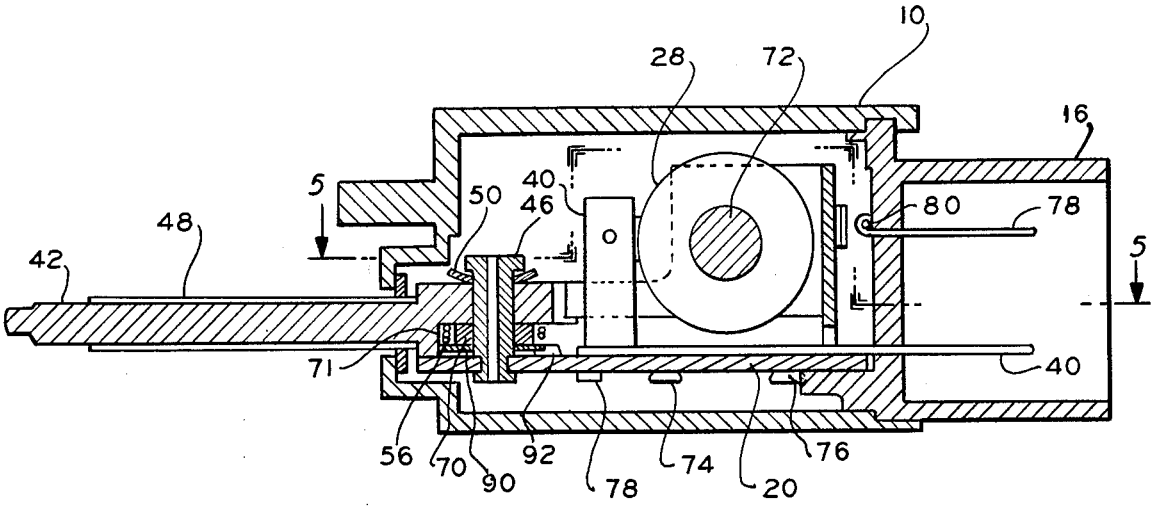
FIG. 4 is a bottom sectional view showing a device which is an alternate to that shown in FIG. 2.

Referring now to FIG. 4, an alternate device is shown which is similar to that illustrated in FIG. 2 except for a conductive arm and equipment associated therewith. This arm is shown herein as metal washer 90 having a radially projecting arm 92 that is bowed downwardly to give it a tubular shape with a radial axis. This tubular arm 92 contacts board 20 and is held in engagement therewith by virtue of the dimensions of undercutting 71 and spacer 70. Washer 90 interlocks and rotates with lever 42. Rotation of lever 42 is restricted so it cannot close armature 30.

Figure 5:
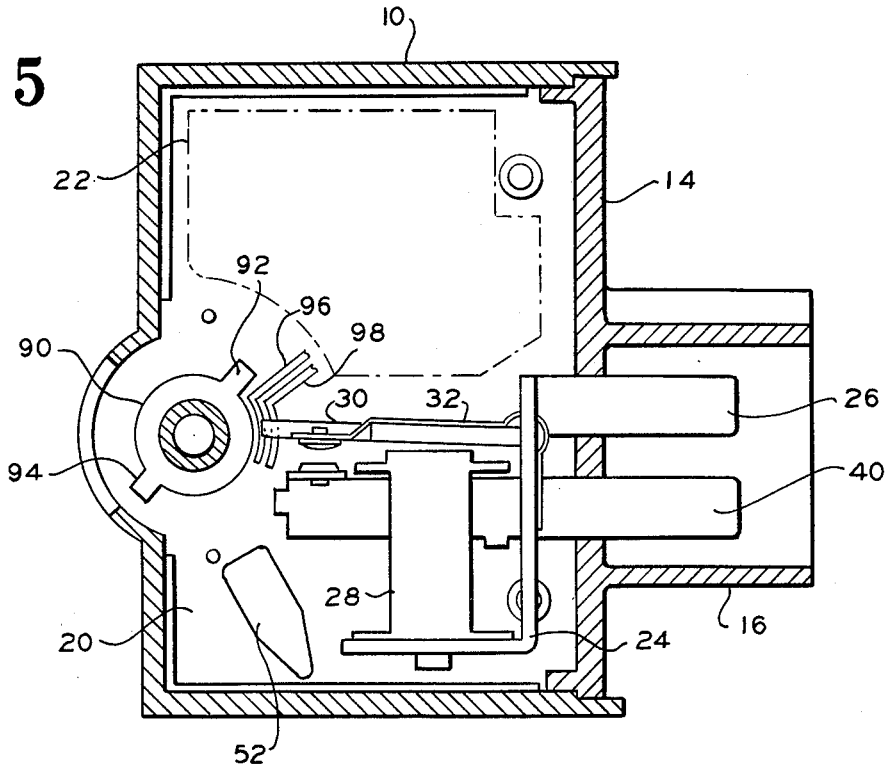
FIG. 5 is a simplified elevational view, partly in section, along lines 5—5 of FIG. 4, in which certain components have been removed for illustration purposes.

Referring now to FIG. 5, the apparatus of FIG. 4 is shown along lines 5—5 of FIG. 4. However, in this figure (FIG. 5) previously illustrated lever 42, torsion spring 56, spacer 70 and washer 50 have been removed to more clearly illustrate conductive washer 90. As shown more clearly herein, conductive washer 90 has a forward tab 94 which projects into a corresponding slot (not shown) in lever 42 (FIG. 4). Thus tab 94 causes its lever and washer 90 to rotate together. Also illustrated herein is arm 92 which in its neutral position projects alongside of, without touching, either conductive pads 96 or 98. These pads are also referred to as a conductive element. As illustrated, pads 96 and 98 are narrow, copper laminations on printed circuit board 20. Pads 96 and 98 run parallel courses which are concentric to washer 90 over an angle of about 45°, and which then run radially outward into circuit area 22 on printed circuit board 20. As previously mentioned, arm 92 has a tubular shape with an axis radial to washer 90. Accordingly, were washer 90 rotated clockwise (this view) arm 90 would electrically bridge pads 96 and 98.

Figure 6:
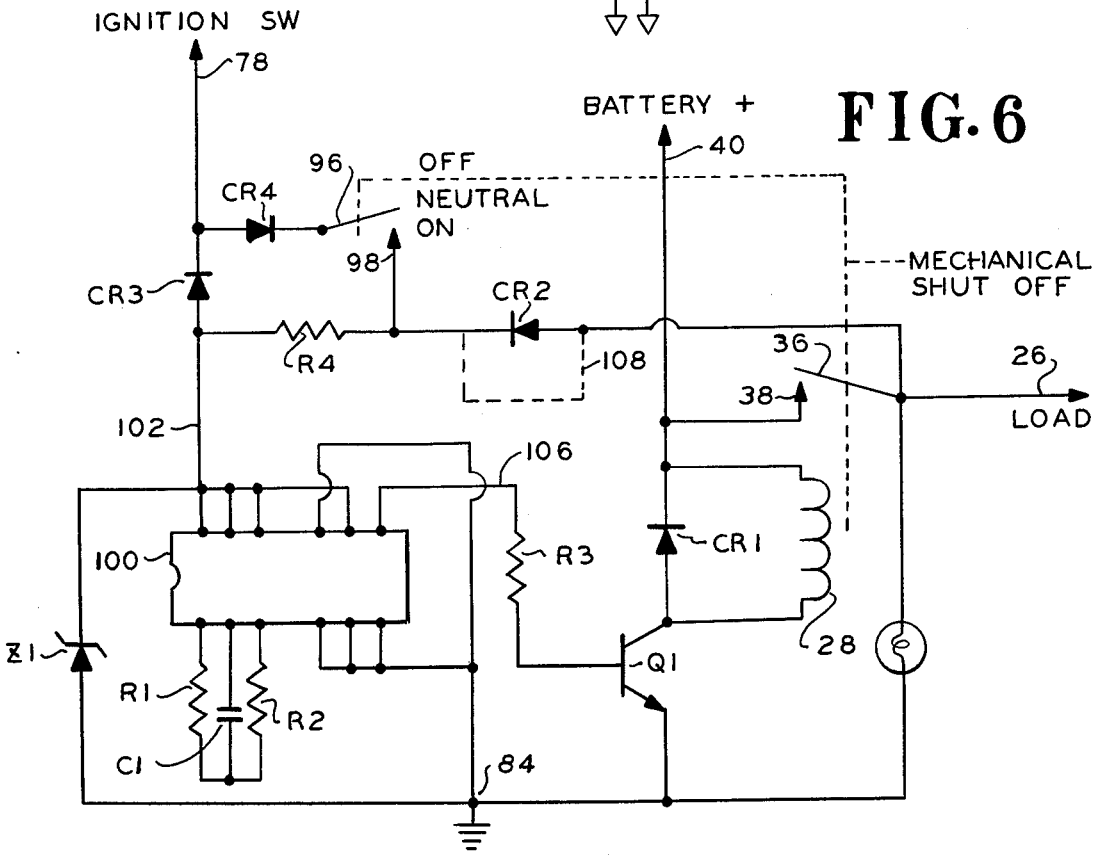
FIG. 6 is a schematic view of the circuit contained in the devices of FIGS. 1-5.

Referring now to FIG. 6 a schematic diagram is given of the circuitry contained in section 22 of printed circuit board 20 for FIG. 5 and the modifications employed for FIG. 1. A timing means, that is part of an initiate means, is shown herein as integrated circuit 100 which has connected thereto timing capacitor C1 together with timing resistors R1 and R2. Integrated circuit 100 is a commercially available timer timed by external resistive and capacitive elements. Integrated circuit 100 receives operating potential along line 102 which is regulated by the Zener diode Z1. Diode Z1 has its cathode connected to line 102 and its anode to the junction of integrated circuit 100 and ground 84. The timed output of integrated circuit 100 is transmitted along line 106. Integrated circuit 100 together with its timing components, resistors R1 and R2 and capacitor C1, operate such that application of an operating voltage on line 102 causes a positive voltage to appear from line 106 for a predetermined time interval, which was in one embodiment 10 minutes. Resistor R3 is connected between line 106 and the base of NPN transistor Q1, its emitter and collector being connected to ground and the anode of diode CR1, respectively. Coil 28 is wound about bobbin 28 (FIGS. 1 and 4) and is connected in parallel across diode CR1, whose cathode is connected to the junction of fixed contact 38 and power terminal 40. Movable contact 36 is connected to the anode of diode CR2 and output terminal 26. Terminals 26 and 40 were previously illustrated in FIGS. 1 and 5. The cathode of diode CR2 is connected to pad 98 and one terminal of resistor R4. The other terminal of resistor R4 is connected to line 102 and the anode of diode CR3, a unilateral conducting device. The ignition switch terminal 78 is connected to the junction of the cathode of diode CR3 and the anode of diode CR4. The cathode of diode CR4 is connected to pad 96. While pads 96 and 98 are illustrated as a fixed and movable contact, it is to be understood that they are both fixed pads on a printed circuit board which are electrically bridged by the movable arm 92 previously illustrated in FIG. 5. Similarly, the previously illustrated prongs 26, 40, 78 and 84 correspond to the similarly identified terminals and ground illustrated herein. For the embodiment of FIG. 1, items 96, 98, CR2 and CR4 are replaced by jumper 108.

In order to show the overall system operation the operation of the circuit of FIG. 6 will be briefly described. Terminal 78 is connected to the ignition circuit in a motor vehicle (not illustrated) and receives a battery voltage when the motor vehicle is running. This battery voltage is continuously applied to terminal 40 and terminal 26 is connected to the power input of an accessory such as a rear window heating device.

Upon manual actuation, electrical continuity is achieved between pads 96 and 98 which, assuming the automobile is running, causes a current to flow from terminal 78 through diode CR4 and resistor R4 into line 102. With voltage thus applied to line 102, integrated timing circuit 100 is actuated and a positive voltage is transmitted along line 106 through resistor R3 to the base of transistor Q1, which turns on. Accordingly, a conduction path is provided from battery terminal 40 through coil 28 and transistor Q1 to ground 84. The magnetic field consequently generated by coil 28 attracts moving contact 36. It is to be understood that although this magnetic field is weak, contact 36 has already been manually moved into proximity with coil 28 which can therefore pull movable contact 36 against fixed contact 38. Accordingly, the battery voltage at terminal 40 is applied through closed contacts 36 and 38 to the diode CR2, forward biasing it. Consequently, voltage is now continuously and independently applied through diode CR2 and resistor R4 to line 102. Accordingly, lever 42 (FIG. 4) can be released, thereby ending the electrical connection between pads 96 and 98 with no further effect.

The voltage applied to line 106 continues undisturbed for the predetermined time interval, in this embodiment 10 minutes. Subsequently, the voltage on line 106 falls to zero volts, causing transistor Q1 to turn off. Accordingly, conduction through coil 28 rapidly ceases, high voltage transients being prevented by damping diode CR1. Therefore, movable contact 36, no longer magnetically held against contact 38, springs away from it. Accordingly, voltage is no longer supplied through diode CR2 nor through contact pad 98. Consequently, energizing potential is removed from integrated timing circuit 100 which becomes inoperative.

Diode CR3 operates as a sensing means which can disable integrating circuit 100 when the ignition switch circuit applies a zero volt signal at terminal 78. Under these circumstances any attempt to apply voltage to line 102 will only cause diode CR3 to forwardly conduct and clamp the voltage at line 102 at essentially zero volts.

For embodiments such as those illustrated in FIGS. 1,2 and 3, wherein pads 96 and 98 are eliminated, diodes CR2 and CR4 can also be eliminated. This alternate connection is shown as dotted line 108. Under these circumstances resistor R4 connects between line 102 and movable contact 36 to provide a switching means. It is to be understood however, that in this latter arrangement, contacts 36 and 38 can be held closed manually without regard to whether the automobile is running.

Figure 7:
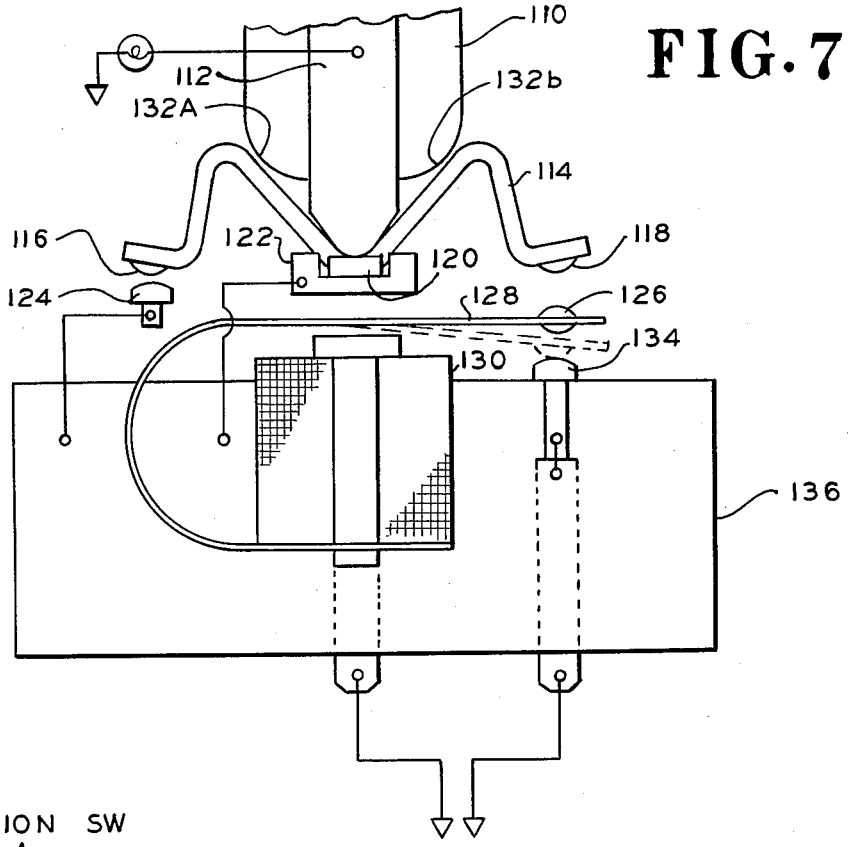
FIG. 7 is a schematic representation of an electromagnetic switching device which is an alternate to that of FIG. 1.

Referring to FIG. 7, an alternate switching device is schematically illustrated. Some of the mechanical details of the operation of this alternate embodiment are given in pending U.S. patent application Ser. No. 927,500 filed July 24, 1978 entitled ELECTRIC SWITCH. Essentially, the switching device of this figure comprises a rotatable knob shown as a rocker assembly frame 110 which is rotatably mounted on trunions (not shown) and a spring biased plunger 112 which is reciprocally mounted within rocker assembly 110. Rocker assembly 110 and plunger 112 bear upon an "M" shaped contact element 114 which has outwardly projecting tabs on which are mounted contacts 116 and 118. Element 114 has trunions 120 extending from it and resting in a pair of "U" shaped receiving frames 122. Mounted adjacent to contacts 116 and 118 are contacts 124 and 126, respectively. Contact 124 is fixed and contact 126 is mounted on a "U" shaped cantilever 128, whose upper branch passes in proximity to the core of coil 130.

The rocker assembly 110 can be actuated by rotating it counter-clockwise (this view). For an initial rotation interval a stop means, shown as shoulder 132*a*, tends to bear against element 114 and restrain it in the position shown. However continued rotation of assembly 110 essentially retracts shoulder 132*a*, freeing element 114. As a result, spring biased plunger 112 can extend and rotate element 114 clockwise, causing contact 118 to close against contact 126 and drive it toward but not against contact 134. Once contacts 126 and 118 are closed an external circuit (similar to that of FIG. 6) is completed which then applies energizing potential to coil 130, causing cantilevered arm 128 to be drawn into the position illustrated by the dotted lines. Alternatively, contact 126 can be driven into contact 134 entirely by the manual operation of assembly 110. In either event, a timing circuit as previously described can be employed to hold contact 126 for a predetermined interval.

It is also to be noted that this embodiment provides an additional contact pair by contacts 116 and 124. This additional pair of contacts can be closed by rotating rocker assembly 110 in the opposite direction, that is, clockwise. Obviously, these additional contacts can be employed to operate additional equipment or to provide additional functions. Preferably, closure of contacts 116 and 124 disables coil 130 and its timing circuit so that contact 126 returns to its normally open position.

As mentioned, previously illustrated timing apparatus of FIG. 6 may be connected to the apparatus of FIG. 7 so that the movable contact 126 of FIG. 7 can be held in place for a predetermined time interval, notwithstanding that the rocker assembly 110 (FIG. 7) has been returned to its neutral position.

It is appreciated that modifications and alterations can be implemented with respect to the apparatus just described. For example, different materials can be substituted to provide the desired strength, wear etc. Furthermore, the dimensions of the various elements can be altered to provide the desired power rating, voltage rating, switching speed etc. In addition, permanent magnets can be installed at various locations to supplement the magnetic energy provided by the coil means. Moreover, various supplemental contacts can be provided which are operated by the manually operable member. The latter feature can thus provide normally open and normally closed contacts. Obviously, many other modifications and variations of the present invention are possible in light of the above teachings. It is therefore to be understood that within the scope of the appended claims, the invention may be practiced otherwise than as previously described.

What is claimed is:

1. An on-off electromagnetic switching device comprising:

a pair of electrical contacts having open and closed positions;

means comprising a single spring biased armature for controlling the opening and the closing of said electrical contacts;

said armature having an open position in which said contacts are opened and a closed position in which said contacts are closed, said closed position being determined by the closing of said contacts;

means for mounting said armature in operative association with said contacts so that the armature is freely movable between said open and said closed positions, without stop means or other mechanical restraints except for the bias of said spring, during both the "off" as well as the "on" condition of said device;

an electromagnetic coil having a pole piece spaced from said armature in the open position of said armature by a distance such that the magnetic field created by said coil is insufficient to move said armature out of its open position;

manually operated means for moving said armature out of its open position to a position intermediate its open and closed positions in which the spacing between armature and said pole piece is sufficiently narrowed that the magnetic force exerted by said field on said armature is sufficient to move said armature from said intermediate to said closed position, and thereafter to maintain it in its closed position until said magnetic field is interrupted; and switching means for energizing said coil upon said armature arriving at its intermediate position with a current sufficient to attract said armature from its intermediate to its closed position.

2. In a motor vehicle, an electrical relay mechanism subject to vibration caused by movements of said vehicle, comprising:

a pair of electrical contacts having open and closed positions;

means comprising a single spring biased armature for controlling the opening and the closing of said electrical contacts and having an open position in which said contacts are open and a closed position in which said contacts are closed, said open and closed positions being spaced apart by a distance such that vibrations of the vehicle will not cause the armature to move to its closed position and close said electrical contacts;

means for mounting said armature in operative association with said contacts for free reciprocation between said open position and said closed position, without stop means or other mechanical restraint except for the bias of said spring;

an electromagnetic coil having a pole piece spaced from said armature by a distance such that the magnetic field emanating from said pole piece is insufficient to draw said armature from its open position against the bias of said spring; and manually operated means for mechanically moving said armature from its open position to a position intermediate said open and said closed positions and at the same time energizing said coil with a current of sufficient strength to create a magnetic field of sufficient strength to draw said armature from its intermediate position to its closed position and to maintain said armature in its closed position until said current is interrupted.

* * * * *